US007128698B2

(12) United States Patent
Shifferaw

(10) Patent No.: US 7,128,698 B2
(45) Date of Patent: Oct. 31, 2006

(54) AIR RESISTANCE EXERCISE DEVICE AND METHOD

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 22 days.

(21) Appl. No.: 10/996,202

(22) Filed: Nov. 22, 2004

(65) Prior Publication Data

US 2006/0116257 A1 Jun. 1, 2006

(51) Int. Cl.
*A63B 21/008* (2006.01)
*A63B 23/02* (2006.01)

(52) U.S. Cl. ..... 482/111; 482/92

(58) Field of Classification Search ..... 482/7, 482/51, 55, 56, 72, 87–90, 92, 110, 111, 148; 446/26–28, 61, 216, 230, 242–243, 473; 473/219, 221, 223–224, 228, 457, 461, 463, 473/527; 440/101–103; 280/810; 89/36.05; 416/69, 70 A, 70 R; 441/56
See application file for complete search history.

(56) References Cited

U.S. PATENT DOCUMENTS 1,291,464 A * 1/1919 Folliard ..... 473/527
RE16,671 E 7/1927 Walters
1,677,888 A * 7/1928 Connors ..... 416/71
2,919,919 A 1/1960 Ebb
3,031,794 A * 5/1962 Zalkind ..... 43/137
3,097,375 A 7/1963 Griffith
3,529,313 A 9/1970 Girden
4,416,451 A * 11/1983 Solloway ..... 482/111
4,603,854 A * 8/1986 Krausz ..... 482/111
4,858,916 A 8/1989 Beaumont
4,890,861 A * 1/1990 Bachmann ..... 280/810
4,923,418 A 5/1990 Hoffman
5,002,275 A * 3/1991 Beutler et al. ..... 473/228
5,071,089 A * 12/1991 Fagan ..... 244/16
5,100,148 A * 3/1992 Smith ..... 473/228
5,190,512 A * 3/1993 Curran ..... 482/124
5,304,080 A 4/1994 Dilger
5,378,217 A 1/1995 D'Orta
5,531,657 A * 7/1996 Macedo ..... 482/111
5,658,224 A 8/1997 Betrock
6,315,700 B1 11/2001 Shifferaw

FOREIGN PATENT DOCUMENTS

FR 2707510 A1 * 1/1995

* cited by examiner

*Primary Examiner*—Jerome Donnelly
*Assistant Examiner*—Victor K. Hwang
(74) *Attorney, Agent, or Firm*—Edward S. Wright

(57) ABSTRACT

Exercise device and method in which one or more generally planar blades with major surfaces are attached to the ends of an exercise bar. The bar is gripped with the hands and moved in a direction generally perpendicular to the major surfaces, with movement of the bar being resisted by air resistance encountered by the blades.

8 Claims, 4 Drawing Sheets

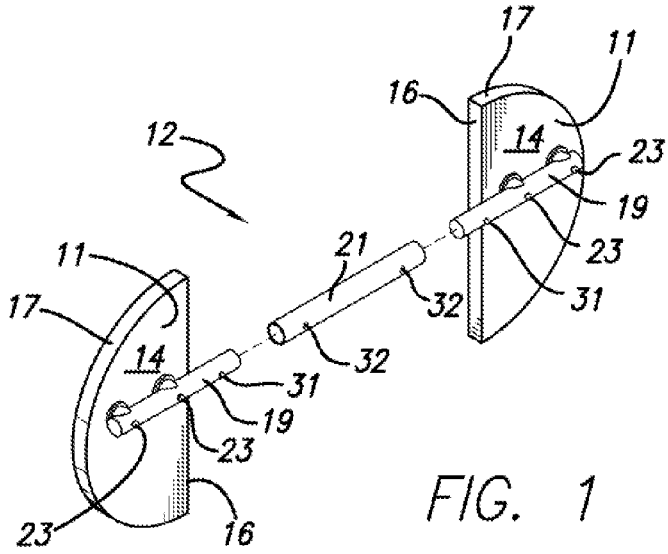
FIG. 1
FIG. 2
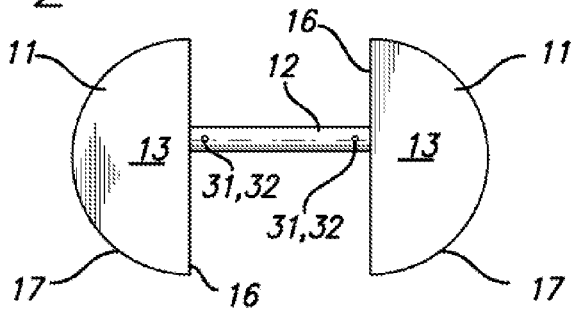
FIG. 3
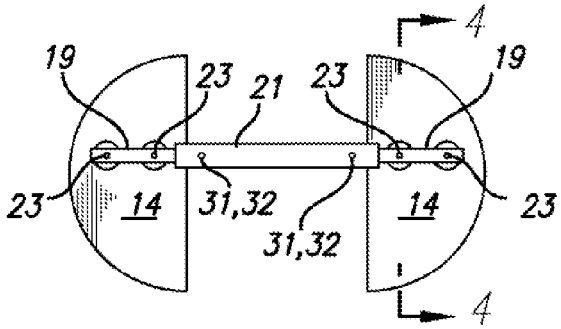
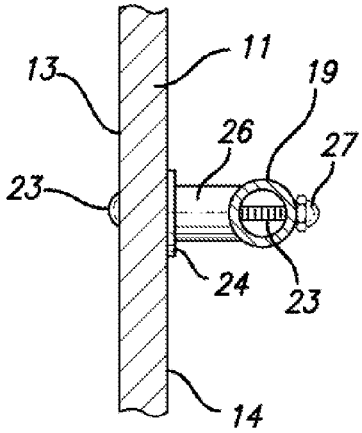
FIG. 4

AIR RESISTANCE EXERCISE DEVICE AND METHOD

This invention pertains generally to exercise equipment and, more particularly, to apparatus and equipment which is particularly suitable for use in aerobic exercise.

In recent years, people have become increasingly aware of the benefits of aerobic exercise for increasing energy, burning fat and strengthening the cardiovascular system. Such exercise can also reduce blood pressure and cholesterol levels, as well as stress, thereby reducing the risk of arteriosclerosis and heart disease.

Some forms of aerobic exercise such as walking, running and swimming can be performed without special equipment, although light weights are sometimes used during such exercise to increase the aerobic resistance. Other forms of aerobic exercise such as cycling and other machine assisted exercises require special equipment which can be quite elaborate and expensive.

High impact forms of exercise such as running can be damaging to the knees, hips and other joints of the body, whereas lower impact exercises may not provide the level of exercise desired without special equipment. Such equipment tends to be expensive and limited as to where it can be used, as well as requiring substantial floor space even when not in use.

A novel exerciser comprising a pair of wings worn on the arms of a person to intensify aerobic workouts is shown in U.S. Pat. No. 6,315,700. The wings have large major surfaces, and movement of the arms is resisted by air resistance encountered when the wings are moved in a direction perpendicular to the surfaces.

It is in general an object of the invention to provide a new and improved device and method for doing aerobic exercise.

Another object of the invention is to provide a device and method of the above character which utilize air resistance to increase the intensity of aerobic workouts.

These and other objects are achieved in accordance with the invention by providing an exercise device and method in which one or more generally planar blades with major surfaces are attached to the ends of an exercise bar. The bar is gripped with the hands and moved in a direction generally perpendicular to the major surfaces, with movement of the bar being resisted by air resistance encountered by the blades.

FIG. 1 is an exploded isometric view of one embodiment of an exercise device according to the invention.

FIG. 2 is a front elevational view of the embodiment of FIG. 1.

FIG. 3 is a rear elevational view of the embodiment of FIG. 1.

FIG. 4 is an enlarged, fragmentary cross sectional view taken along line 4—4 in FIG. 3.

Figure 5C:
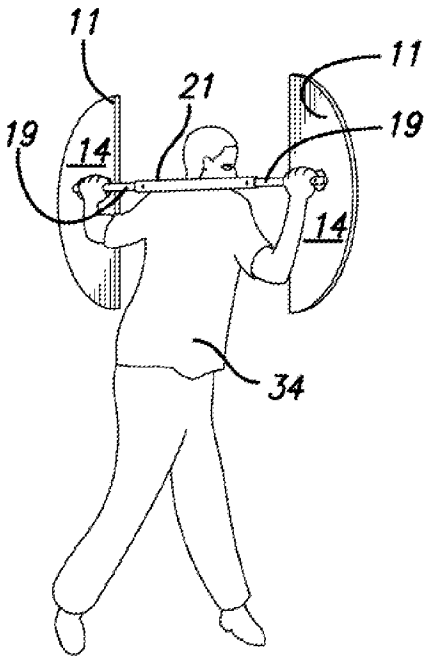
FIGS. 5–7 are isometric views illustrating use of the exercise device in doing different exercises.

As illustrated in the drawings, the device has a pair of relatively large, generally planar blades 11, 11 at opposite ends of an exercise bar 12. Each of the blades has major front and rear surfaces 13, 14, with the front surfaces being aligned with each other in a common plane parallel to the exercise bar.

The blades are fabricated of a relatively lightweight, rigid material such as a rigid plastic, a lightweight metal or wood. They have a generally semicircular or D-shaped contour, with straight inner edges 16 and curved outer edges 17. The size of the blades is, in part, dependent upon the amount of air resistance desired, and they typically have a height on the order of 24–36 inches, a width on the order of 18–24 inches, and a thickness on the order of 1–2 inches.

Exercise bar 12 is formed in sections, with end sections 19, 19 and a central section 21. The end sections are affixed to the rear sides of the blades and removably connected to central section 21. The length of the bar is such that the inner edges of the blades are separated by a distance on the order of 24–36 inches and the blades will lie on opposite sides of the body when the bar is held in a horizontal position.

The end sections are attached to the blades by bolts 23, with washers 24 and spacers 26 between the end sections and the blades, and nuts 27 on the outer ends of the bolts. The end sections are thus spaced from and parallel to the blades with sufficient distance between them and the blades to receive the fingers of hands gripping the bar. In the embodiment illustrated, the bar is positioned slightly above the horizontal centerline of the blades, which has been found to provide better balance for some exercises. However, it can also be positioned on the centerline or below it, if desired.

In the embodiment illustrated, the central section of the bar is tubular, and end sections 19 extend into the end portions of the central section. The end sections are secured to the central section by detents consisting of spring-loaded pins 31 on the end sections and openings 32 in the side wall of the central section. The end sections are assembled to the central section by depressing the detent pins, sliding the end sections into the outer ends of the central section, and aligning the pins with the openings. They are removed by depressing the pins and withdrawing the end sections.

The bar is fabricated of a lightweight, relatively rigid material such as aluminum or plastic. In one embodiment, the central section is a length of aluminum tubing, and the outer sections are lengths of PVC tubing.

Figure 5B:
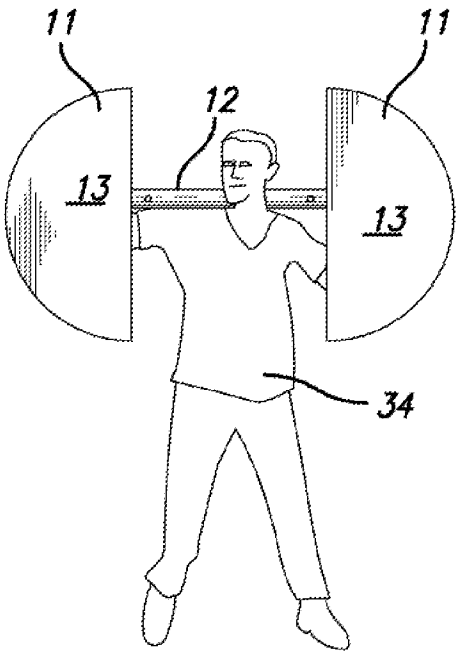
Figure 5A:
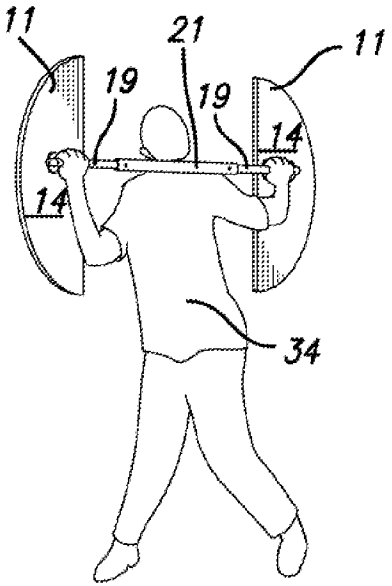

Use of the device in doing a twisting abdominal exercise is illustrated in FIGS. 5A–5C. With the bar resting on his shoulders and his hands gripping the end sections of the bar, an exerciser 34 alternately rotates or twists his body to the right and to the left. As he does, the blades are moved in a direction perpendicular to their major surfaces, and the resulting air resistance creates additional work for the abdomen and torso, with the amount of the resistance being dependent upon the size of the blades and the speed at which they are moved.

In addition to providing resistance for the exerciser to work against, the air resistance also prevents over extension of the back and provides cushioning to the movement of the exerciser.

Figure 6A:
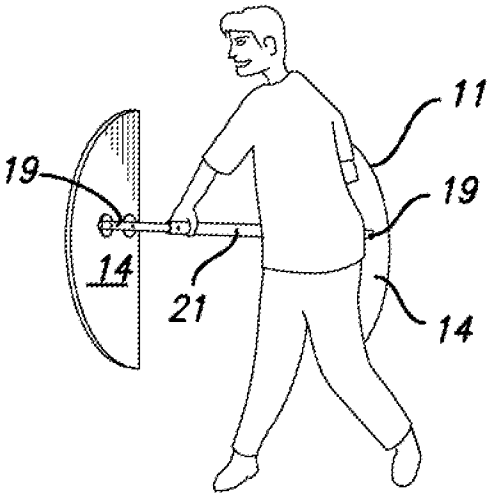
Figure 6B:
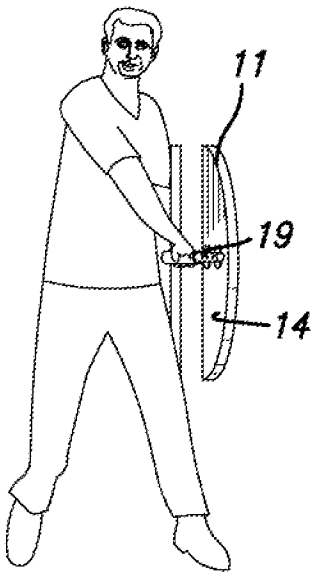
Figure 6C:
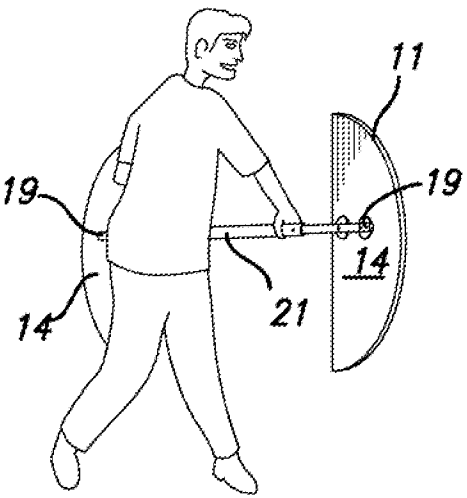

In the exercise illustrated in FIGS. 6A–6C, the exerciser grips the central section of the bar, with his hands over the bar and his arms extended in a downward direction near his sides. He once again rotates his body alternately to the right and to the left, swinging the bar in a direction generally perpendicular to the major surfaces of the blades as he does so. The resistance of the air to the movement of the blades works the torso, trapezium, abdomen and arms, much like rowing exercises and kayaking.

Figure 7A:
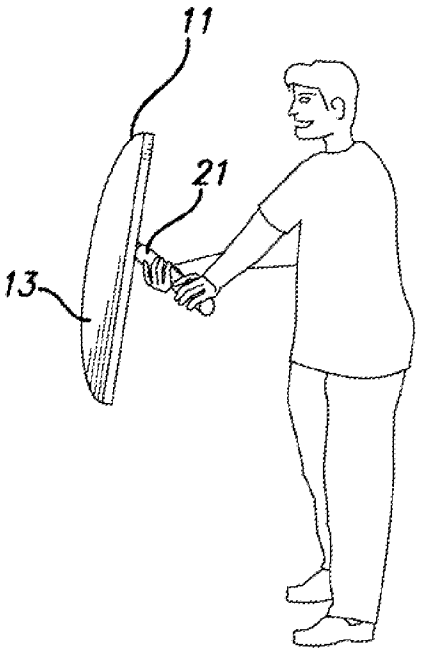
Figure 7B:
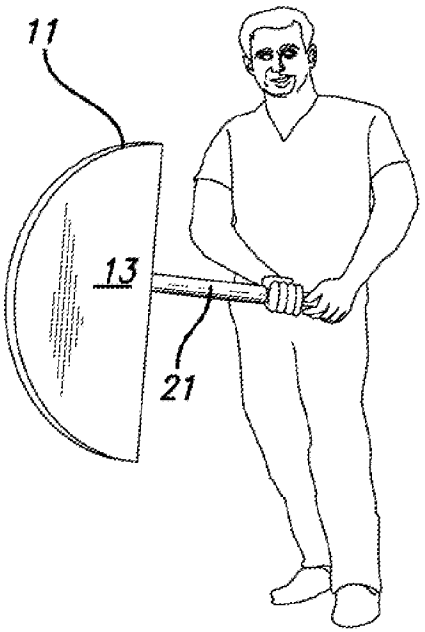
Figure 7C:
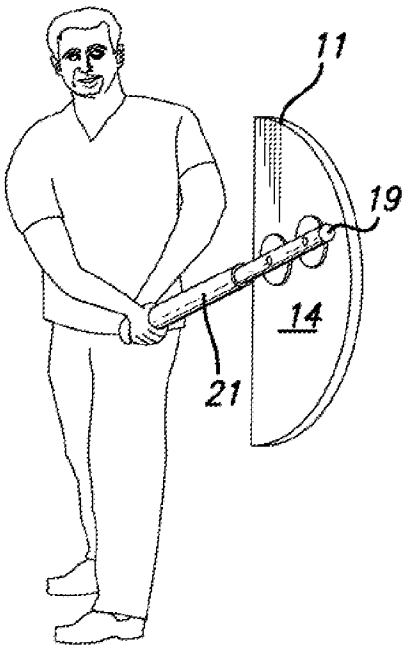

The device can also be used as a trainer for a particular sport, and FIGS. 7A–7C show it being used as a baseball trainer. For that purpose, the blade is removed from one end of the bar, and the exerciser grips that end in a manner similar to the way he would grip a baseball bat. He then swings the device back and forth in front of him, exercising the same muscles that are used in swinging a bat. By gripping the bar and swinging the device in the manner of a golf club, tennis racket or the like, the device can be used to exercise the muscles used those and other sports. The cushioning provided by the air resistance makes the device particularly suitable for use in rehabilitating the muscles that are used for the particular sport.

The invention has a number of important features and advantages. It provides a simple, lightweight device and method for intensifying the effect of aerobic exercise. The exerciser can control the amount of resistance by swinging the device faster or slower, depending upon the degree of exercise desired. In addition to providing resistance for the exerciser to work against, the air resistance also prevents over extension and provides cushioning to the movement of the exerciser. The device can be used to exercise and/or rehabilitate the muscles that are used in a variety of exercises and sports.

It is apparent from the foregoing that a new and improved exercise device and method have been provided. While only certain presently preferred embodiments have been described in detail, as will be apparent to those familiar with the art, certain changes and modifications can be made without departing from the scope of the invention as defined by the following claims.

The invention claimed is:

1. An exercise device comprising a rigid bar having end portions which are adapted to be gripped by the hands of a person using the device, a pair of generally planar blades having front and rear major surfaces which are resistant to movement through air in a direction perpendicular to the surfaces, and means mounting the blades to the bar with the end portions of the bar extending behind the blades and being spaced rearwardly of the blades by a distance sufficient that portions of the hands gripping the bar can pass between the bar and the blades.

2. The exercise device of claim 1 wherein the blades are oriented with the major surfaces of the two blades in a common plane.

3. The exercise device of claim 1 wherein the bar is formed in sections which are rigidly connected together.

4. The exercise device of claim 3 wherein the bar has a tubular central section and a pair of end sections which extend into the central section and are secured to the central section by detent mechanisms.

5. The exercise device of claim 1 wherein the means mounting the blades to the bar comprises a pair of fasteners extending between each of the end portions and a corresponding one of the blades and spacers on the fasteners between the end sections by detent mechanisms.

6. An exercise device comprising a pair of generally planar blades with front and rear major surfaces which are resistant to movement through air in a direction perpendicular to the surfaces, an exercise bar having end sections and a central section, means affixing the blades to the end sections of the bar with the end sections extending to the rear of the blades and being spaced from the blades by a distance such that hands gripping the bar can pass between the bar and the blades, and means connecting the end sections to the central section of the bar with the major surfaces of the two blades oriented in a predetermined manner relative to each other.

7. The exercise device of claim 6 wherein the means affixing the end sections to the blades comprises a pair of fasteners extending between each of the end sections and a corresponding one of the blades and spacers on the fasteners between the end sections and the blades.

8. The exercise device of claim 6 wherein the central section of the bar is tubular, and the end sections extend into end portions of the central section and are secured to the central section by detent mechanisms.

* * * * *